United States Patent [19]

Bubien

[11] Patent Number: 4,881,779

[45] Date of Patent: Nov. 21, 1989

[54] PACKED TRANSPORTABLE FURNITURE

[75] Inventor: Ray Bubien, Rolling Hills Estates, Calif.

[73] Assignee: Arma, Inc., Rolling Hills Estates, Calif.

[21] Appl. No.: 332,891

[22] Filed: Apr. 3, 1989

[51] Int. Cl.[4] ..... A47C 7/00

[52] U.S. Cl. ..... 297/442; 297/16; 297/440

[58] Field of Search ..... 297/440, 442, 462, 16, 297/92; 5/DIG. 1, 114

[56] References Cited

U.S. PATENT DOCUMENTS

| | | | |
|---|---|---|---|
| 2,877,832 | 3/1959 | Reavis | 297/442 |
| 2,955,647 | 10/1960 | Smith | 297/442 X |
| 3,097,016 | 7/1963 | Bigler | 297/442 |
| 3,121,588 | 2/1964 | Beckman et al. | 297/442 X |
| 3,425,764 | 2/1969 | Budd | 297/462 |
| 3,582,172 | 6/1971 | Clark | 297/462 |

*Primary Examiner*—James T. McCall
*Attorney, Agent, or Firm*—Lee W. Tower

[57] ABSTRACT

Packed transportable furniture has a foldable reversible furniture frame which has a container mode and a frame mode. In the container mode the foldable reversible furniture frame is in the form of a box and the outside surfaces of the box are made of corrugated paper, fiberboard or the like. In the frame mode the foldable reversible furniture frame forms the frame of a chair or sofa with the outside surfaces being covered with foam or bonded polyester padding. The packed transportable furniture has honeycomb supports for structural support, padded back and seat platforms, a slip cover and cushions. These are packed inside the foldable reversible furniture frame in the container mode for shipment. Provision is provided for keeping the slip cover tight by either having holes in the bottom of the foldlable reversible furniture frame or hooks placed in eyelets located on the honeycomb supports through which slip cover draw strings are tied. A third method is to sew a "pocket" in the slip cover where the seat and the back are joined. A tongue of the seat platform is then inserted into the "pocket" during assembly holding the fabric in place. A fourth method is to have "velcro" attachment points strategrically placed. The furniture is weighted by an attached weighted bottom or by sandbags placed inside the furniture.

18 Claims, 3 Drawing Sheets

FIG. 1
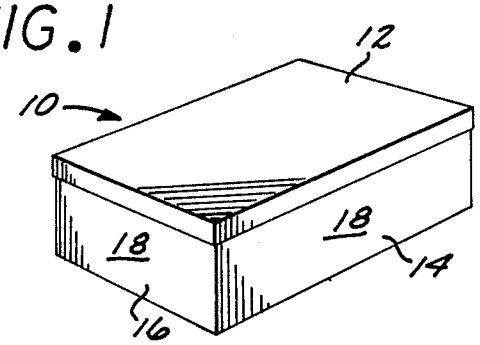
FIG. 2
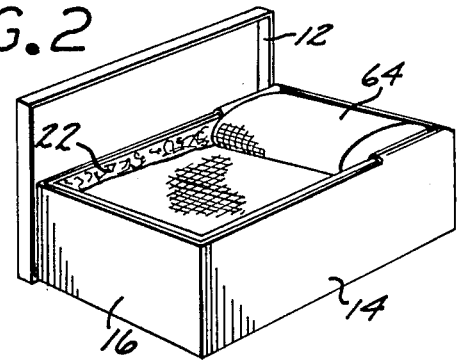
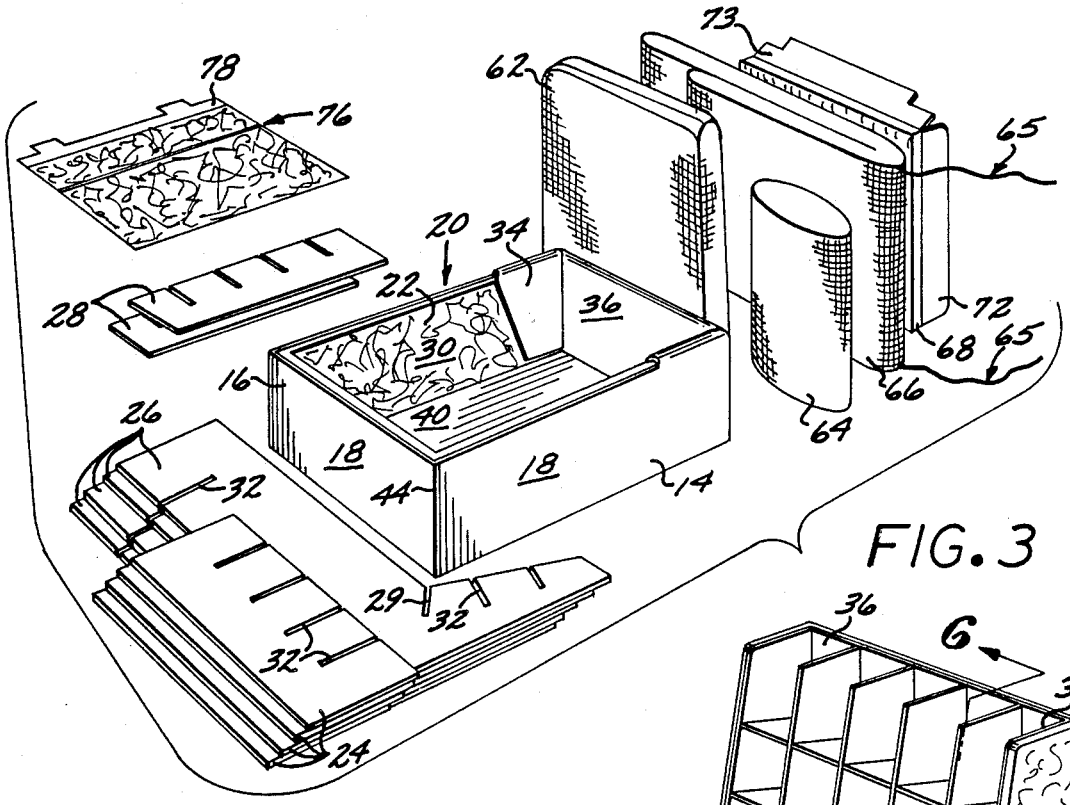
FIG. 3
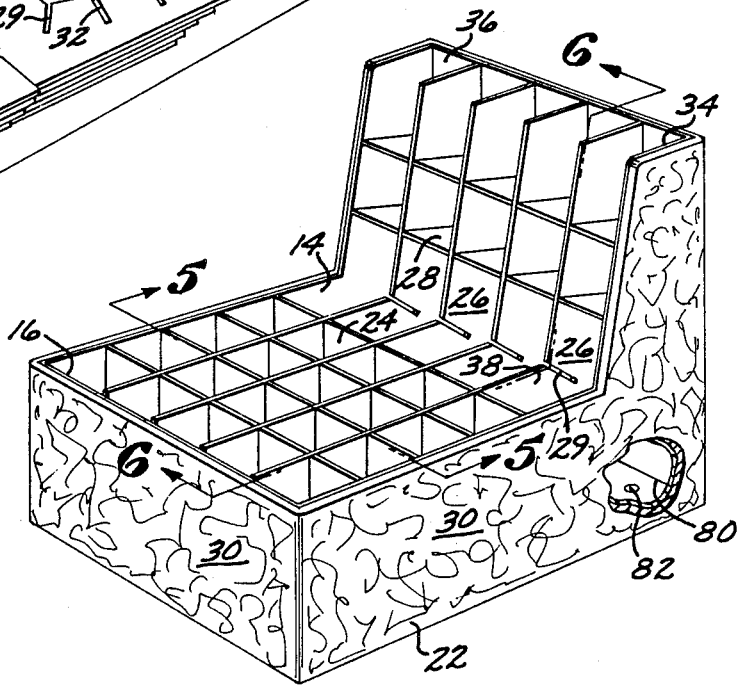
FIG. 4

FIG. 5
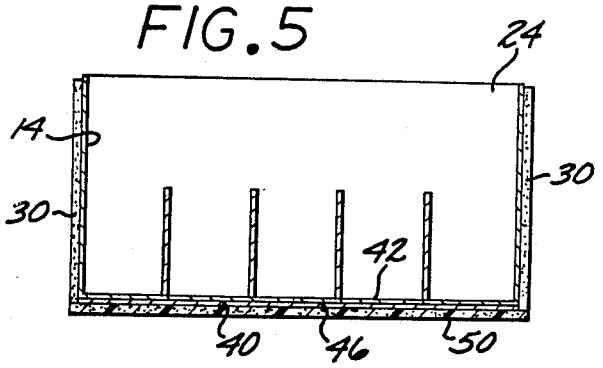
FIG. 6
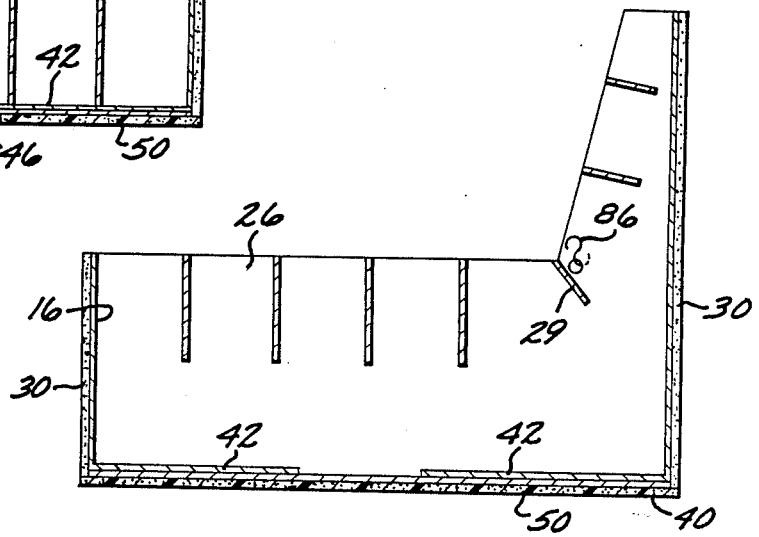
FIG. 7
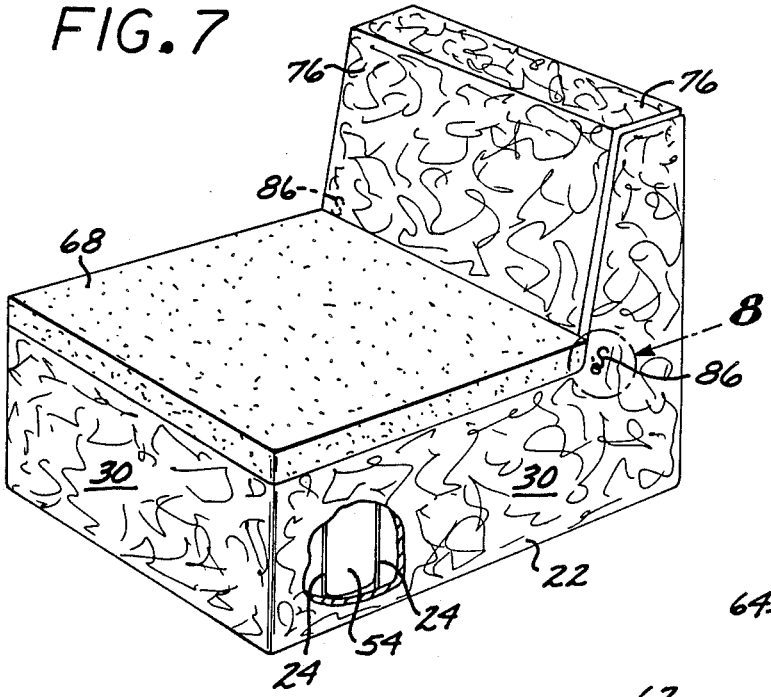
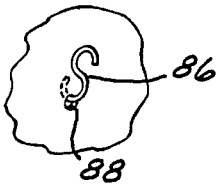
FIG. 8
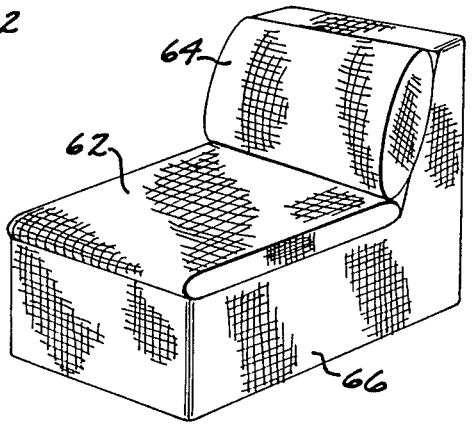
FIG. 9

PACKED TRANSPORTABLE FURNITURE

BACKGROUND OF THE INVENTION

1. Field of the Invention

This invention relates generally to furniture and more particularly furniture made of corrugated paperboard and knockdown furniture capable of being easily disassembled and transported.

2. Prior Art

The prior art teaches how to fabricate chairs and other furniture items from cardboard or corrugated board and the like. For example Klein U.S. Pat. No. 4,085,970, Smith No. 2,707,514, Holden No. 2,940,513, and Notko No. 3,695,703 all disclose paperboard chairs.

There are various means for transporting knockdown furniture. In most of the art a separate container for holding the parts is generally used, as in Reinhold U.S. Pat. No. 2,660,228. Other patents disclose using a seat as a container for holding the parts such as Roeshman U.S. Pat. No. 3,892,441 and U.S. Pat. No. 2,701,009 to Richard.

A disadvantage of all of the knockdown furniture of the prior art is that either an extra storage container had to be supplied at extra cost or the furniture design was compromised if the seat was used as a storage container. If the seat is used as a container during shipment then the appearance of the furniture can be damaged, which is the case for the Roeshman and Richard design.

Other disadvantages of the knockdown furniture of the past includes insufficient means for securing the slip covers and the light weight of the assembled furniture.

SUMMARY OF THE INVENTION

A piece of furniture such as a chair or sofa formed in accordance with this invention possesses the desirable features of other articles made of corrugated paper or fiberboard, solid fiber board or the like. These features include economy and lightness, while at the same time providing a very sturdy and durable construction.

An important new feature of the present invention is the ability to pack the furniture without using an additional container or risking damage to the appearance of the furniture during shipment. The latter is avoided by having a design that allows the furniture to be reversed and turned inside out. The inside of the container becomes the outside of the furniture during use. An advantage of this design is that padding can be installed on one side of the furniture, which is fully protected when the furniture is in its container mode, because the padded side of the furniture is then on the inside of the container. When the container is reversed to become furniture the padding is on the outside of the furniture and lends a pleasing aspect to the design.

Most of the prior art discloses chair designs. The present invention also applies to sofas, loveseats, arm chairs and sectional pieces. A key feature that allows this is that the back of the sofa and other pieces can be integrated directly into the design in the same manner as for the chair design.

Another new feature is the inclusion in the design of methods of firmly holding the slip cover in place. This is especially critical along the crease between the seat and the back of a chair or sofa. In normal furniture this is done by attaching the cover to the furniture frame. In this design it is accomplished by strategically attaching hooks onto the inside structure of the fiber board furniture to which the slip cover draw strings can be drawn.

Another method is having eyelets in the furniture bottom through which the slip cover draw strings can be drawn. A third method is to sew a "pocket" in the slip cover where the seat and the back are joined. A tongue attached to the seat or back platform is then inserted into the "pocket" during assembly holding the fabric in place. A fourth method is to have "velcro" attachment points strategically placed.

A feature of fiber board furniture is that it is lightweight. This is an advantage during shipment; however, when the furniture is assembled this same advantage becomes a disadvantage because the furniture moves or can tip over too easily. This last problem is addressed in this invention by providing weight for the furniture in the form of sand bags in between the honeycomb structure or by providing a weighted base.

The features of the present invention which are believed to be novel are set forth with particularity in the appended claims. Other objects any many of the attendant features of this invention will be more readily appreciated as the same becomes better understood by reference to the following detailed descriptions and considered in connection with the accompanying drawings in which like reference symbols designate like parts throughout the figures.

BRIEF DESCRIPTION OF THE DRAWINGS

FIG. 1 is a perspective view of the packed transportable furniture in its container mode for shipment.

FIG. 2 is a perspective view of the packed transportable furniture in its container mode with the lid removed.

FIG. 3 is a perspective view of the packed transportable furniture in its container mode with the contents removed.

FIG. 4 is a perspective view of the packed transportable furniture partially assembled in its furniture mode and a cutout showing a eyelet on the bottom surface.

FIG. 5 is a front sectional view of the packed transportable furniture along the line 5—5 in FIG. 4.

FIG. 6 is a side sectional view of the packed transportable furniture along the line 6—6 in FIG. 4.

FIG. 7 is a perspective view of the packed transportable furniture in its furniture mode with the seat and back installed and showing a cutout for a hook and eyelet and another cutout showing a sandbag installed for weight.

FIG. 8 is a blow-up of a portion of FIG. 7 showing a hook installed in the fiber board structure.

FIG. 9 is a perspective view of the fully assembled packed transportable furniture.

DESCRIPTION OF THE PREFERRED EMBODIMENTS

Figure 10:
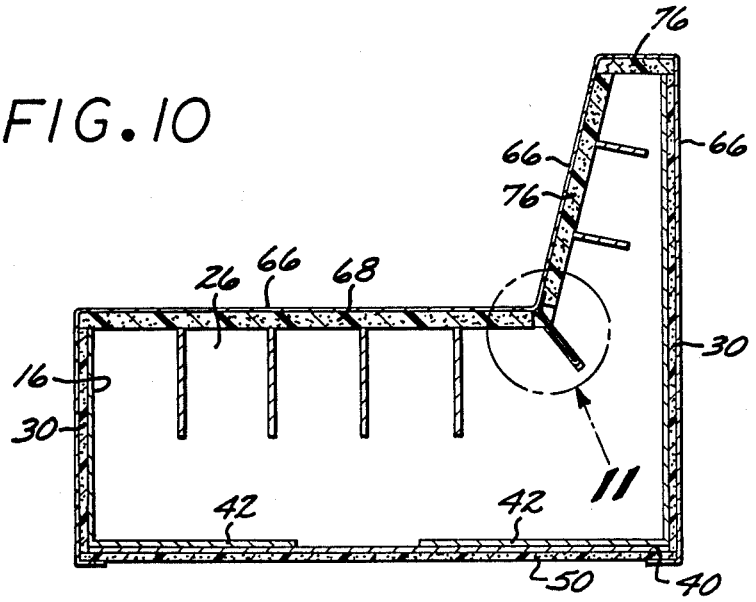
FIG. 10 is a side sectional view of the packed transportable furniture in the same plane as FIG. 6 showing a seat platform, back platform, and slip cover having a slip cover pocket.

Referring now to the drawings, and more particularly, to FIG. 1, packed transportable furniture 10 is shown in its container mode, which appears as a box with a lid 12. The outside of the packed transportable furniture 10, such as container mode right side 14 and container mode front side 16, are made of cardboard or fiber board 18. FIG. 2 shows the packed transportable furniture in its container mode with the lid 12 removed, which reveals that the contents of packed transportable furniture 10 when in the container mode. The first step in assembling the furniture is to unpack all the contents. FIG. 3 shows the packed transportable furniture with the contents removed. The contents include: latitudinal honeycomb supports 24, longitudinal honeycomb supports 26, back honeycomb supports 28, seat cushion 62, back cushion 64, slip cover 66, seat platform 68, and back platform 76. After the contents are removed what is left is reversible furniture frame 20. As shown, the inside surface of the reversible furniture frame 20 has foam or bonded polyester padding 30. Also shown are some sides folded inside reversible furniture frame 20, such as back side support 34 and back support 36, which together provide back support for a seat or cushion.

The next step in the assembly process is to unfold reversible furniture frame 20. One edge 44 can be untaped or otherwise parted. The first bottom flaps 40 and second bottom flaps 42 of reversible furniture frame 20, as shown in FIGS. 3, 5 and 6, can be unfolded once they and edge 44 are untaped. It is then possible unfold the box entirely and then fold it again so that the inside of reversible furniture frame 20 becomes the outside. The result is shown in FIG. 4. As shown, the container mode right side 14 of FIG. 3 becomes the left inside surface of FIG. 4. Note that furniture mode right side 22 was on the left inside of reversible furniture frame 20 in FIG. 3. Similarly, the container mode front side 16 becomes the front inside surface of FIG. 4. The key thing is that now the foam or bonded polyester padding 30 is on the outside of the reversible furniture frame 20.

In the process of unfolding and refolding reversible furniture frame 20, back side support 34 and back support 36 are folded into an upright position and appear on the inside of reversible furniture frame 20 in FIG. 4. The outside of back side support 34 and back support 36 have foam or bonded polyester padding 30.

A key benefit of this arrangement is that the outside of the reversible furniture frame 20 in the furniture mode is protected during shipment, because all of the foam or bonded polyester padded surfaces are on the inside of packed transportable furniture 10, as shown in FIG. 1.

FIG. 4 shows the installation of latitudinal honeycomb supports 24, longitudinal honeycomb supports 26 and back honeycomb supports 28 inside the reversible furniture frame 20. This honeycomb structure is quite strong and has been used before on this type of furniture.

FIG. 5 is a section of FIG. 4 showing installed latitudinal honeycomb supports 24. Also shown are the first bottom flaps 40 and second bottom flaps 42. FIG. 6 is also a section of FIG. 4 and shows an installed longitudinal honeycomb supports 26 and first bottom flaps 40 and second bottom flaps 42.

FIG. 7 shows the furniture with the seat platform 68 and back platform 76 installed. To hold back platform 76 in place, back platform tab 78, as shown in FIG. 3, is tucked in along back support 36. Seat platform 68 is similarly held in place with seat platform tabs 72. Finally, FIG. 9 shows the furniture after the slip cover 66, seat cushion 62, and back cushion 64 have been installed.

There are a number of alternate methods for keeping the slip cover 66 firmly in place along the crease between the seat platform 68 and back platform 76. One method is illustrated in FIG. 4 and consists of having a slip cover draw string eyelet 82 in the bottom surface of reversible furniture frame 20 on both sides close to the bottom/back surface juncture 80. The slip cover draw strings 65, shown in FIG. 3 are simply threaded through the eyelets and tied. An alternate provision for securing the slip cover draw strings is to attach them to hooks 86, which are attached to hook eyelets 88 in longitudinal honeycomb supports 26, as shown in FIGS. 6 and 7.

Figure 11:
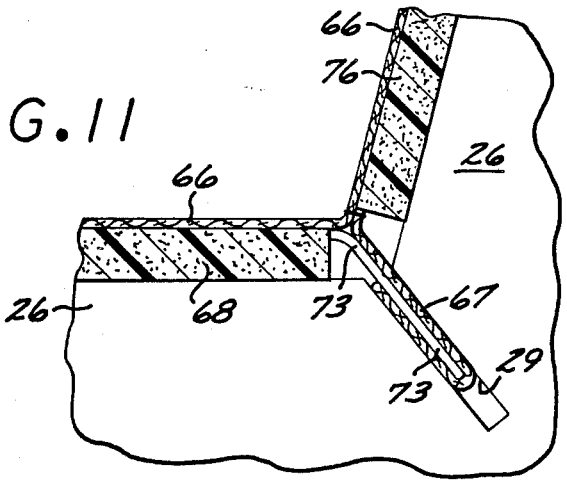
FIG. 11 is a blowup of a portion of FIG. 10 showing a platform tongue inside a slip cover pocket inserted into a holder slot.

A third method of securing the slip cover, which is shown in FIGS. 10 and 11, is to sew a slip cover pocket 67 into the slip cover 66 where the seat and back are joined. The platform tongue 73 or a tongue on back platform 76 is then inserted into slip cover pocket 67 and inserted into holder slots 29 in longitudinal honeycomb supports 26.

Figure 12:
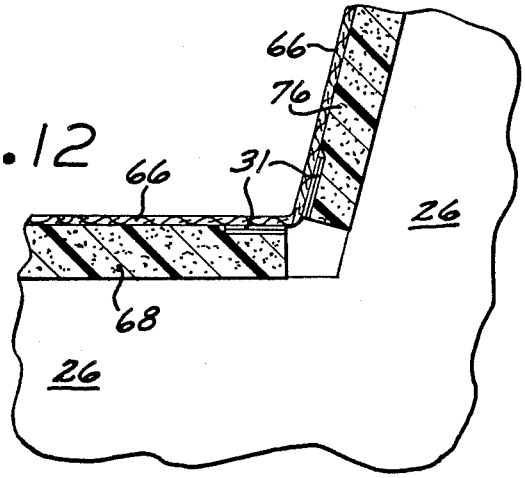
FIG. 12 is a detail of an alternate method for securing the slip cover using "velcro" fasteners.

A fourth method of securing the slip cover consists of having "velcro" fasteners 31 mounted on seat platform 68 and back platform 76 near where the seat and back are joined. Then "velcro" fasteners 31 in the corresponding locations on slip cover 66 are mated with the velcro fasteners on the seat and back platforms. This is illustrated in FIG. 12.

To weight the furniture, there are two alternate provisions. The first is to attach a weighted bottom surface weight 50, as shown in FIGS. 5 and 6. Bottom surface weight 50 can be placed on the inside or outside of furniture frame 20. The weighted bottom surface can be attached with nuts and bolts or clips. The second alternate provision for weighting the bottom is to put sandbags 54 in the spaces between the latitudinal honeycomb supports 24 and longitudinal honeycomb supports 26, as shown in the cutout in FIG. 7.

It is thought that the packed transportable furniture of the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A packed transportable furniture article of manufacture made of corrugated paper or fiberboard that comprises:

a foldable reversible furniture frame having left, right, front, and rear sides, bottom flanges, and a back support wherein said left, right, front and rear sides and said back support are covered on one surface with foam or bonded polyester padding; and wherein said foldable reversible furniture frame has a container mode and a frame mode such that when in said container mode said foldable reversible furniture frame is folded to form an open box with all outside surfaces of said box being corrugated paper or fiberboard and such that when said foldable reversible furniture frame is in said frame mode said foldable reversible furniture frame is folded to form a frame for a chair loveseat, sofa, or sectional sofa and said foam or bonded polyester padding on said left, right, front and rear sides and said back support is on the outside surfaces of said foldable reversible furniture frame; and a honeycomb support having longitudinal and latitudinal members forming a seat structure and a back structure mounted inside said foldable reversible furniture frame in said frame mode and packed inside said foldable reversible furniture frame in said container mode; and a seat platform placed on top of said honeycomb support on said seat structure when said foldable reversible furniture frame is in said frame mode and packed inside said foldable reversible furniture frame in said container mode; and a back platform placed on top of said honeycomb support on said back structure when said foldable reversible furniture frame is in said frame mode and packed inside said foldable reversible furniture frame in said container mode.

2. The packed transportable furniture article of manufacture of claim 1 that further comprises:

a slip cover having a draw string placed over said seat and back platforms when said foldable reversible furniture frame is in said frame mode and packed inside said foldable reversible furniture frame in said container mode; and hook eyelets mounted on said honeycomb support; and hooks mounted in said hook eyelets for keeping said slip cover tight between said seat platform and said back platform by tieing said draw string to said hooks.

3. The packed transportable furniture article of manufacture of claim 1 that further comprises:

a slip cover having a draw string placed over said seat and back platforms when said foldable reversible furniture frame is in said frame mode and packed inside said foldable reversible furniture frame in said container mode; and draw string eyelets mounted in said bottom flaps so that said slip cover can be kept tight between said seat platform and said back platform by tieing said draw string through said draw string eyelets.

4. The packed transportable furniture article of manufacture of claim 1 that further comprises:

a slip cover placed over said seat and back platforms when said foldable reversible furniture frame is in said frame mode and packed inside said foldable reversible furniture frame in said container mode; and a slip cover pocket attached to said slip cover at the crease of sad slip cover at the junction of said seat and back platforms; and a tongue attached to said seat platform or said back platform and inserted into said slip cover pocket; and a holder slot on each longitudinal honeycomb support at the junction of the seat and back structures; and wherein said tongue inserted into said slip cover pocket is in turn inserted into said holder slot on each longitudinal honeycomb support for the purpose of holding said slip cover tight at the junction of said seat and back platforms.

5. The packed transportable furniture article of manufacture of claim 1 that further comprises:

a slip cover placed over said seat and back platforms when said foldable reversible furniture frame is in said frame mode and packed inside said foldable reversible furniture frame in said container mode; and a "velcro" fastener attached to said slip cover at the crease in said slip cover at the junction of said seat and back platforms; and a "velcro" fastener attached to said seat platform near the junction of said seat and back platforms; and a "velcro" fastener attached to said back platform near the junction of said seat and back platforms for the purpose of holding said slip cover tight.

6. The packed transportable furniture article of manufacture of claims 2, 3, 4 or 5 that further comprises:

a bottom surface weight attached to said bottom flaps when said foldable reversible furniture frame is in said frame mode for providing stability and weight to said foldable reversible furniture frame.

7. The packed transportable furniture article of manufacture of claims 2, 3, 4 or 5 that further comprises:

at least one sandbag placed between said honeycomb support on top of said bottom flaps when said foldable reversible furniture frame is in said frame mode for providing stability and weight to sad foldable reversible furniture frame.

8. A packed transportable furniture article of manufacture made of corrugated paper or fiberboard that comprises:

a foldable reversible furniture frame having left, right, front, and rear sides, and bottom flaps wherein said left, right, front and rear sides are covered on one surface with foam or bonded polyester padding; and wherein said foldable reversible furniture frame has a container mode and a frame mode such that when in said container mode said foldable reversible furniture frame is folded to form an open box with all outside surfaces of said box being corrugated paper or fiberboard and such that when said foldable reversible furniture frame is in said frame mode said foldable reversible furniture frame is folded to form a frame for an ottoman or foot stool and said foam or bonded polyester padding on said left, right, front and rear sides in on the outside surfaces of said foldable reversible furniture frame; and a honeycomb support having longitudinal and latitudinal members forming a seat structure mounted inside said foldable reversible furniture frame in said frame mode and packed inside said foldable reversible furniture frame in said container mode; and a seat platform placed on top of sad honeycomb support on said seat structure when said foldable reversible furniture frame is in said frame mode and packed inside said foldable reversible furniture frame in said container mode.

9. The packed transportable furniture article of manufacture of claim 8 that further comprises:

a bottom surface weight attached to said bottom flaps when said foldable reversible furniture frame is in said frame mode for providing stability and weight to said foldable reversible furniture frame.

10. The packed transportable furniture article of manufacture of claim 8 that further comprises:

at least one sandbag placed between said honeycomb support on top of said bottom flaps when said foldable reversible furniture frame is in said frame mode for providing stability and weight to said foldable reversible furniture frame.

11. The packed transportable furniture article of manufacture of claim 9 or 10 that further comprises:

a slip cover placed over said seat platform when said foldable reversible furniture frame is in said frame mode and packed inside said foldable reversible furniture frame in said container mode.

12. A packed transportable furniture article of manufacture made of corrugated paper or fiberboard that comprises:

a foldable reversible furniture frame having left, right, front, and rear sides, bottom flaps, a back support, and a back side support wherein said left, right, front and rear sides, said back support and said back side support are covered on one surface with foam or bonded polyester padding; and wherein said foldable reversible furniture frame has a container mode and a frame mode such that when in said container mode said foldable reversible furniture frame is folded to form an open box with all outside surfaces of said box being corrugated paper or fiberboard and such that when said foldable reversible furniture frame is in said frame mode said foldable reversible furniture frame is folded to form a frame for a chair loveseat, sofa, or sectional sofa and said foam or bonded polyester padding on said left, right, front and rear sides, said back support and said back side support is on the outside surfaces of said foldable reversible furniture frame; and a honeycomb support having longitudinal and latitudinal members forming a seat structure and a back structure mounted inside said foldable reversible furniture frame in said frame mode and packed inside said foldable reversible furniture frame in said container mode; and a seat platform placed on top of said honeycomb support on said seat structure when said foldable reversible furniture frame is in said frame mode and packed inside said foldable reversible furniture frame in said container mode; and a back platform placed on top of said honeycomb support on said back structure when said foldable reversible furniture frame is in said frame mode and packed inside said foldable reversible furniture frame in said container mode.

13. The packed transportable furniture article of manufacture of claim 12 that further comprises:

a slip cover having a draw string placed over said seat and back platforms when said foldable reversible furniture frame is in said frame mode and packed inside said foldable reversible furniture frame in said container mode; and hook eyelets mounted on said honeycomb support; and hooks mounted in said hook eyelets for keeping said slip cover tight between said seat platform and said back platform by tieing said draw string to said hooks.

14. The packed transportable furniture article of manufacture of claim 12 that further comprises:

a slip cover having a draw string placed over said seat and back platforms when said foldable reversible furniture frame is in said frame mode and packed inside said foldable reversible furniture frame in said container mode; and draw string eyelets mounted in said bottom flaps so that said slip cover can be kept tight between said seat platform and said back platform by tieing said draw string through said draw string eyelets.

15. The packed transportable furniture article of manufacture of claim 12 that further comprises:

a slip cover placed over said seat and back platforms when said foldable reversible furniture frame is in said frame mode and packed inside said foldable reversible furniture frame in said container mode; and a slip cover pocket attached to said slip cover at the crease of said slip cover at the junction of said seat and back platforms; and a tongue attached to said seat platform or said back platform and inserted into said slip cover pocket; and a holder slot on each longitudinal honeycomb support at the junction of the seat and back structures; and wherein said tongue inserted into said slip cover pocket is in turn inserted into said holder slot on each longitudinal honeycomb support for the purpose of holding said slip cover tight at the junction of said seat and back platforms.

16. The packed transportable furniture article of manufacture of claim 12 that further comprises:

a slip cover placed over said seat and back platforms when said foldable reversible furniture frame is in said frame mode and packed inside said foldable reversible furniture frame in said container mode; and a "velcro" fastener attached to said slip cover at the crease in said slip cover at the junction of said seat and back platforms; and a "velcro" fastener attached to said seat platform near the junction of said seat and back platforms; and a "velcro" fastener attached to said back platform near the junction of said seat and back platforms for the purpose of holding said slip cover tight.

17. The packed transportable furniture article of manufacture of claims 13, 14,15 or 16 that further comprises:

a bottom surface weight attached to said bottom flaps when said foldable reversible furniture frame is in said frame mode for providing stability and weight to said foldable reversible furniture frame.

18. The packed transportable furniture article of manufacture of claims 13, 14, 15 or 16 that further comprises:

at least one sandbag placed between said honeycomb support on top of said bottom flaps when said foldable reversible furniture frame is in said frame mode for providing stability and weight to said foldable reversible furniture frame.

* * * * *